US007651731B2

(12) United States Patent
Martins Miranda et al.

(10) Patent No.: US 7,651,731 B2
(45) Date of Patent: Jan. 26, 2010

(54) NIOBIUM-BASED COMPOSITIONS AND COATINGS, NIOBIUM OXIDES AND THEIR ALLOYS APPLIED BY THERMAL SPRAYING AND THEIR USE AS AN ANTICORROSIVE

(75) Inventors: Luiz Roberto Martins Miranda, Rio de Janeiro (BR); Ladimir José Carvalho, Rio de Janeiro (BR); Antônio Carlos Gonçalves Pereira, Rio de Janeiro (BR)

(73) Assignee: Coppe/UFRJ-Coordenacao dos Programas de Pos Graduacao de Engenharia da Universidade Federal do Rio de Janeiro, Rio de Janeiro (BR)

( * ) Notice: Subject to any disclaimer, the term of this patent is extended or adjusted under 35 U.S.C. 154(b) by 808 days.

(21) Appl. No.: 10/525,366

(22) PCT Filed: Nov. 13, 2002

(86) PCT No.: PCT/BR02/00152

§ 371 (c)(1), (2), (4) Date: Feb. 23, 2005

(87) PCT Pub. No.: WO2004/022806

PCT Pub. Date: Mar. 18, 2004

(65) Prior Publication Data

US 2006/0127577 A1 Jun. 15, 2006

(30) Foreign Application Priority Data

Sep. 6, 2002 (BR) ..... 0203534

(51) Int. Cl.
*C23C 16/00* (2006.01)

(52) U.S. Cl. ..... 427/250

(58) Field of Classification Search ..... 427/250
See application file for complete search history.

(56) References Cited

U.S. PATENT DOCUMENTS 5,645,893 A * 7/1997 Rickerby et al. ..... 427/405

* cited by examiner

*Primary Examiner*—Kamal A Saeed
(74) *Attorney, Agent, or Firm*—Fildes & Outland, P.C.

(57) ABSTRACT

The novelty proposed herein describes the application of niobium-based compositions and coatings, niobium oxides and their alloys capable of associations with other oxides and alloys by means of the thermal spraying technique for the purpose of an anticorrosive protection in highly corrosive environments, mainly those which present high temperatures, show presence of gases such as $H_2S$, $SO_2$, $CO_2$, as well as organic and inorganic acids, commonly found in industrial centers.

4 Claims, No Drawings

NIOBIUM-BASED COMPOSITIONS AND COATINGS, NIOBIUM OXIDES AND THEIR ALLOYS APPLIED BY THERMAL SPRAYING AND THEIR USE AS AN ANTICORROSIVE

THECHNICAL FIELD

This invention refers to the application of niobium-based compositions and coatings, niobum oxides and their alloys capable of association with other oxides and alloys by means of the thermal spraying technique for the purpose of an anticorrosive protection in highly corrosive environments, mainly those wich present high temperatures, show presence of gases such as $H_2S$, $SO_2$, $CO_2$ as well as organic and inorganic acids.

PRIOR TECHNIQUES

The Brazilian Patent Application n° PI 0102414-0 refers to niobium-based compositions and coatings, niobium oxides and their possible associations with other oxides and their use by means of common painting techniques and not by electrodeposition through molten salts or equivalents thereof used in electroplating, it being understood that same is proposed to neutralize the highly corrosive effect of naphthenic acids and sulphur components, which very quickly destroy carbon steel and special alloys such as stainless steel of virtually all chromium alloys and nickel alloys families, and for use not only as a coating in petroleum refining units, but also in industrial units which present similar problems.

SUMMARY OF THE INVENTION

In its most general aspect, this invention proposes the use of niobium, niobium oxides, niobium alloys and associations thereof with other metals, alloys or oxides as an anticorrosive coating applied by a thermal spraying technique over carbon steel surfaces and other metallic materials of current use in industrial centers.

DETAILED DESCRIPTION OF THE INVENTION

This invention refers more particularly to formulations comprising the use of niobium and oxides and alloys thereof such as Ni—Nb, Fe—Nb, HNb, among others by granulometric classification that allows their application by a thermal spraying equipment.

The components referred to above obey the following characteristics:

Melting point: a maximum of 2000° C.
Density: 4.47-8.0 g/cm$^3$
% niobium oxide: 99.4
Sulphur ppm: 10
Fe ppm: 229
Pb ppm: <1
Granulometry: [−180 to 45 μm](100-400# Tyler mesh size)

Thermal spraying is a set of coating process in which metallic or non-metallic materials in the form of a powder or a wire are molten in the nozzle of appropriate guns, and then projected under pressure towards the surface to be coated. Due to the high pressure, these molten materials come out from the guns as microdroplets which, upon approaching, the substrate become grouped and then are deposited in the form of "flakes", sometimes also called "pancakes". From this moment on, there are depositions of successive layers and thus a thermo-sprayed characteristic coating provided with superposed "pancakes". These flakes are affixed to the substrate by mechanical anchoring processes, and therefore there is the need of a prior preparation of the substrate so as to enable required anchoring conditions.

The surface to be sprayed thermically must be previously cleaned. The cleaning process consists of the following phases:

1—Surface Pre-Cleaning.

It consists of the removal of sludge, corrosion products, coatings residues, insoluble incrustations, scales and gross particulates through mechanical processes (hydro-jetting or abrasive blasting), chemical processes (degreasing, acid cleaning) or thermal processes (burning, direct flame, reducing atmosphere).

2—Final Cleaning.

It consists of the preparation of the surface by the blasting process so as to eliminate products that prevent the contact between the coating and the substrate. The surface must achieve a Sa3 cleaning quality and a given roughness, that is surface conditions allowing for the adherence of the coating to the substrate.

3—Preheating.

Preheating during its pre-cleaning is, in fact, a cleaning by the action of the flame and its purpose is to provide the burning and volatization of greases, oils and humidity retained at the metal substrate in the event of failure of the other cleaning methods. It can also be used after the final cleaning so as to reduce all residual tensions (which have an influence upon the adhesion and cohesion of the layer) and to remove any residual humidity. The preheating temperature values depend further upon the material of the layer, of the type of the substrate, and of its physical properties.

The coating process refers to the exemple 1 which consists of the application of niobium oxide by thermal spraying to the flame.

EXAMPLE 1

Application of a Niobium Oxide Layer Over a 3 mm Thick Carbon Steel Plate

Initially, the surface is blasted, to get it cleaned and to obtain the desired roughness, with white aluminium oxide granulometry 30 alundum 38 A; to obtain the Sa3 cleaning degree by comparison with all surface quality standards as published by NACE RM 01/70 rule. Then the surface must be heated for removal of humidity; to control the heating so that the temperature is not in excess of 150° C.; in the sequence, to apply a pre-layer of Ni, Al and Mo (bonder) agglomerate with a minimum thickness of 10 μm, for the purpose of providing the adherence of the coating. An alternative for the pre-layer of adherence is the 40A1-60Nb agglomerate. Finally, to fill up the equipment with niobium oxide with a granulometry between −180 to 45 μm, to adjust the parameters and carry out the application.

Parameters for application of niobium oxide and niobium alloys:

Oxygen pressure: 2.0 to 4.0 kg/cm$^2$
Acetylene pressure 0.5 to 1.0 kg/cm$^2$
Deposition rate regulation(*): 5-15

(*) Depending on the thickness of the layer to be applied, the deposition rate must be altered.

Upon application the deposited layer must have the following characteristics:

A—Thickness

Verify the thickness using a thickness meter specific for measuring non magnetic layers over magnetic substrates. For a primer the thickness of the layer applied must be in the range of 100 μm.B B—Adherence Glue to the applied layer with an adhesive a peg of 25.4 mm in diameter which upon curing is tensioned in a tension machine. The adherence value must be between 10 and 40 Mpa.

C—Electrode Power

Up to 100° C. the electrochemical power measured in relation to the saturated calomel over a carbon steel substrate must show the value of −600+/=50 $mV_{ecs}$.

D—Instilling of HCl of P.A. Purity

It must not show deteriorations in the coating and show yellow oxidation characteristic of the oxide reaction.

The above defined parameters should not be deemed to be restricted to the scope of this invention, as other forms of application by thermal spraying can be used.

The invention claimed is:

1. A method of applying a Niobium Oxide coating as an anti-corrosive, the method comprising the steps of:

pre-cleaning a metallic surface that will receive the Niobium Oxide coating;

blasting, with abrasive, to attain a roughness necessary for coating anchoring;

pre-heating the metallic surface; and applying the coating by thermal aspersion.

2. The method according to claim 1, wherein the Niobium Oxide coating has the following characteristics:

melting point: 1512° C.;

specific gravity: 4.6 g/$cm^3$;

niobium oxide %: 99.4;

sulphur (ppm): less than 10;

iron (ppm): up to 229;

lead (ppm): less than 1; and granulometry: 100-400 #Tyler mesh size.

3. The method according to claim 1, including the step of:

applying a 40 Al-60 Nb agglomerate as a pre-layer promoter of adherence between the metallic substrate and the Niobium Oxide layer.

4. The method according to claim 1, wherein parameters for the coating application, by thermal aspersion, are:

oxygen pressure: from 2.0 up to 4.0 kg/$cm^3$;

acetylene pressure: from 0.5 up to 1.0 kg/$cm^3$; and coating deposition rate: from 5 up to 15.

* * * * *